US007373904B2

(12) United States Patent
Bharathan et al.

(10) Patent No.: US 7,373,904 B2
(45) Date of Patent: May 20, 2008

(54) STRATIFIED VAPOR GENERATOR

(75) Inventors: Desikan Bharathan, Lakewood, CO (US); Vahab Hassani, Golden, CO (US)

(73) Assignee: Midwest Research Institute, Kansas City, MO (US)

( * ) Notice: Subject to any disclaimer, the term of this patent is extended or adjusted under 35 U.S.C. 154(b) by 975 days.

(21) Appl. No.: 10/258,719

(22) PCT Filed: Jun. 12, 2001

(86) PCT No.: PCT/US01/19415

§ 371 (c)(1),
(2), (4) Date: Feb. 10, 2003

(87) PCT Pub. No.: WO02/101206

PCT Pub. Date: Dec. 19, 2002

(65) Prior Publication Data

US 2003/0150403 A1 Aug. 14, 2003

(51) Int. Cl.
*F27B 37/26* (2006.01)

(52) U.S. Cl. ..... 122/489; 60/653; 60/679

(58) Field of Classification Search ..... 122/209.1, 122/230, 235.35, 240.2, 489, 406.4; 60/653, 60/679, 649, 651, 671
See application file for complete search history.

(56) References Cited

U.S. PATENT DOCUMENTS 3,063,681 A 11/1962 Duguid
3,902,462 A 9/1975 Bryers
3,905,336 A 9/1975 Gamble et al.
4,205,633 A * 6/1980 Wittchow ..... 122/406.4
4,843,824 A 7/1989 Mushines
5,649,426 A * 7/1997 Kalina et al. ..... 60/649
6,347,520 B1 * 2/2002 Ranasinghe et al. ..... 60/649
2003/0167769 A1 * 9/2003 Bharathan et al. ..... 60/676

FOREIGN PATENT DOCUMENTS

EP 0 065 042 A 11/1982
EP 0 649 985 A 4/1995

OTHER PUBLICATIONS

PCT Notification of Transmittal of the International Search Report or the Declaration, PCT/US01/19415, mailed Feb. 6, 2001.

* cited by examiner

*Primary Examiner*—Gregory A. Wilson
(74) *Attorney, Agent, or Firm*—Paul J. White

(57) ABSTRACT

A stratified vapor generator (110) comprises a first heating section ($H_1$) and a second heating section ($H_2$). The first and second heating sections ($H_1$, $H_2$) are arranged so that the inlet of the second heating section ($H_2$) is operatively associated with the outlet of the first heating section ($H_1$). A moisture separator (126) having a vapor outlet (164) and a liquid outlet (144) is operatively associated with the outlet (124) of the second heating section ($H_2$). A cooling section ($C_1$) is operatively associated with the liquid outlet (144) of the moisture separator (126) and includes an outlet that is operatively associated with the inlet of the second heating section ($H_2$).

20 Claims, 4 Drawing Sheets

STRATIFIED VAPOR GENERATOR

CONTRACTUAL ORIGIN OF THE INVENTION

The United States Government has rights in this invention under Contract No. DE-AC36-99GO10377 between the United States Department of Energy and the National Renewable Energy Laboratory, a division of the Midwest Research Institute.

TECHNICAL FIELD

This invention relates to heat exchangers in general and more specifically to a heat exchanger for vaporizing a mixed fluid stream.

BACKGROUND ART

Heat exchangers are well-known in the art and have been used in various forms for centuries to facilitate the transfer of heat from one medium to another. One class of heat exchangers, commonly referred to as boilers or vapor generators, is used to vaporize a working fluid. A portion of the heat used to vaporize the working fluid thereafter may be recovered from the vaporized working fluid to perform useful work. For example, boilers or vapor generators are commonly used in electrical power generation systems in which the working fluid, typically water, is heated in the boiler or vapor generator to produce steam, i.e., vaporized water. The steam is then expanded through a turbine or other such device in order to rotate an electrical generator. In the case of electrical power generation systems, the heat energy required to heat the working fluid may come from a wide variety of sources, including coal, natural gas, geothermal sources, and nuclear sources, although other heat sources may also be used.

While electrical generation systems of the type described above traditionally have used water as the working fluid (e.g., in the well-known Rankine cycle), newly developed thermodynamic cycles (e.g., any one of the so-called Kalina cycles) have been proposed that utilize "mixed" working fluids comprising two or more vaporizable components. The mixed component working fluid vaporizes and condenses progressively over a temperature range rather than at the relatively constant temperature of a so-called "pure" working fluid (e.g., water). Accordingly, thermodynamic cycles utilizing mixed working fluids can, if properly designed, realize increased efficiencies over similar thermodynamic cycles that utilize pure working fluids, such as water.

One design consideration for a thermodynamic cycle that utilizes a mixed working fluid relates to the heat exchanger utilized to transfer heat from the heating medium to the mixed working fluid. That is, since mixed working fluids vaporize over an increasing temperature range, it is generally preferred to design the heat exchanger so that heating function of the mixed working fluid closely follows the cooling function of the heating medium. For example, a primary consideration of geothermal power generation systems relates to the maximum brine flow-rate that can be extracted from the geothermal resource on a continuous or sustainable basis. Of course, regardless of the brine flow rate that can be extracted from a particular geothermal resource, a well-designed geothermal power generation system seeks to maximize the amount of useful work that can be generated from the particular brine flow rate.

DISCLOSURE OF INVENTION

A stratified vapor generator according to the present invention may comprise a first heating section and a second heating section. The first and second heating sections are arranged so that the inlet of the second heating section is operatively associated with the outlet of the first heating section. A separator having a vapor outlet and a liquid outlet is operatively associated with the outlet of the second heating section. A cooling section operatively associated with the liquid outlet of the separator includes an outlet that is operatively associated with the inlet of the second heating section.

Also disclosed is a method for vaporizing a mixed working fluid that includes the steps of: Heating the mixed fluid stream to produce a heated mixture having a vapor component and a liquid component; separating the liquid component from the vapor component; cooling the liquid component to produce a cooled liquid component; and mixing the cooled liquid component with a portion of the mixed fluid stream being heated.

BRIEF DESCRIPTION OF DRAWINGS

Illustrative and presently preferred embodiments of the invention are shown in the accompanying drawings in which.

BEST MODE FOR CARRYING OUT THE INVENTION

A stratified vapor generator 110 according to one embodiment of the present invention is shown and described herein as it could be used in a geothermal power generation system 112 in which energy from a heating medium (e.g., hot brine 114 extracted from the earth) is used to generate electricity. Alternatively, the stratified vapor generator 110 may be used with other types of heating media and in other types of thermodynamic cycles to produce other types of useful work.

Figure 1:
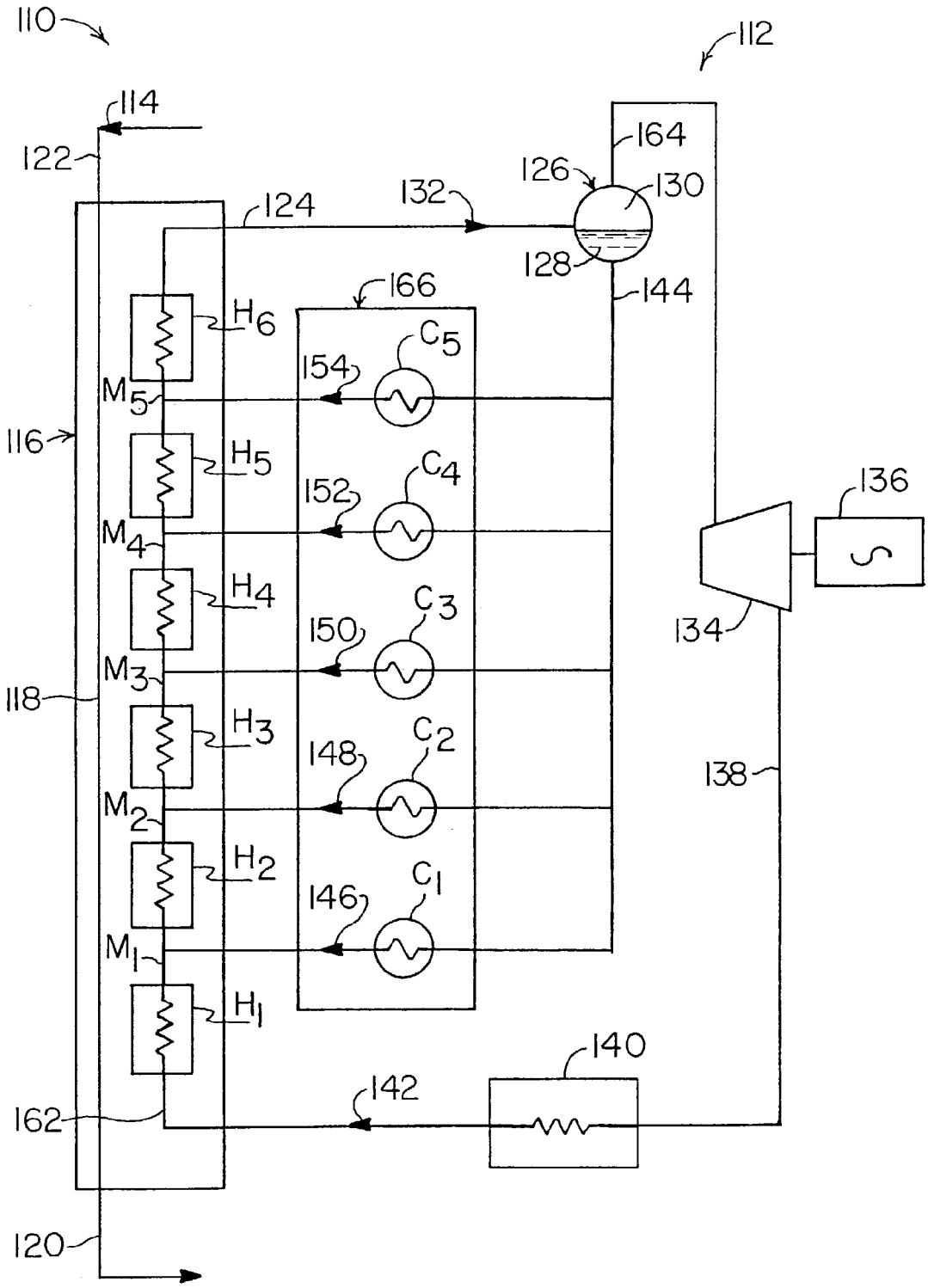
FIG. 1 is a schematic diagram of a stratified vapor generator according to one embodiment of the present invention.

With reference now primarily to FIG. 1, the stratified vapor generator 110 may comprise a heat exchanger 116 having at least two, and preferably more, heating sections provided therein. For example, in the embodiment shown and described herein, the heat exchanger 116 is provided with six heating sections, $H_1$, $H_2$, $H_3$, $H_4$, $H_5$, and $H_6$. The heating sections (e.g., $H_{1-6}$) of the heat exchanger 116 are thermally adjacent a primary loop 118 through which flows a heating medium, such as hot brine 114. The arrangement of the heating sections $H_{1-6}$ of the heat exchanger 116 is such that the first heating section $H_1$ is thermally adjacent the heating fluid outlet 120 of the primary loop 118 and so that the last heating section $H_6$ is thermally adjacent the heating fluid inlet 122 of primary loop 118.

The outlet 124 of the last heating section $H_6$ is operatively connected to a separator system 126. The separator system 126 separates a liquid component 128 and a vapor component 130 from the heated mixed working fluid stream 132 exiting the heat exchanger 116. The vapor component 130 may be directed to a suitable energy conversion device for conversion into useful work. The energy conversion device may operate in accordance with any of a wide range of thermodynamic cycles and processes that are now known in the art or that may be developed in the future, as would be obvious to persons having ordinary skill in the art after having become familiar with the teachings of the present invention. Accordingly, the present invention should not be regarded as limited to any particular energy conversion device and/or thermodynamic cycle for converting into useful work the heat energy contained in the vapor component 130. However, by way of example, in the embodiment shown and described herein, the vapor component 130 is directed to a turbine 134 which extracts a portion of the heat energy contained in the vapor component 130. The turbine 134 is in turn connected to an electrical generator 136 which converts the rotational energy of the turbine 134 into electrical energy. The exhaust stream 138 from turbine 134 may be condensed in a condenser 140, if necessary, before being returned to the heat exchanger 116 as feed stream 142.

The liquid component 128 from the separator system 126 is divided into various streams and recycled to the heat exchanger 116 at various mixing points in accordance with the teachings provided herein. For example, in the embodiment shown and described herein, the liquid outlet 144 of separator system 126 is connected to at least one, and preferably a plurality, of cooling sections $C_1$, $C_2$, $C_3$, $C_4$, and $C_5$. The cooling sections $C_{1-5}$ are in turn connected to the heat exchanger 116 at various respective mixing positions $M_1$, $M_2$, $M_3$, $M_4$, and $M_5$ intermediate the various heating sections $H_{1-6}$ of the heat exchanger 116.

The stratified vapor generator 110 according to the present invention may be operated as follows to vaporize a mixed working fluid comprising a feed stream 142. As was briefly described above, the mixed working fluid utilized herein vaporizes progressively over an increasing temperature range. That is, the temperature of the vapor and liquid comprising the heated mixed working fluid increases with increasing quality. The point at which vaporization begins (i.e., at 0% quality) is referred to herein as the "bubble point," whereas the point at which vaporization is complete (i.e., at 100% quality) is referred to herein as the "dew point."

Figure 2:
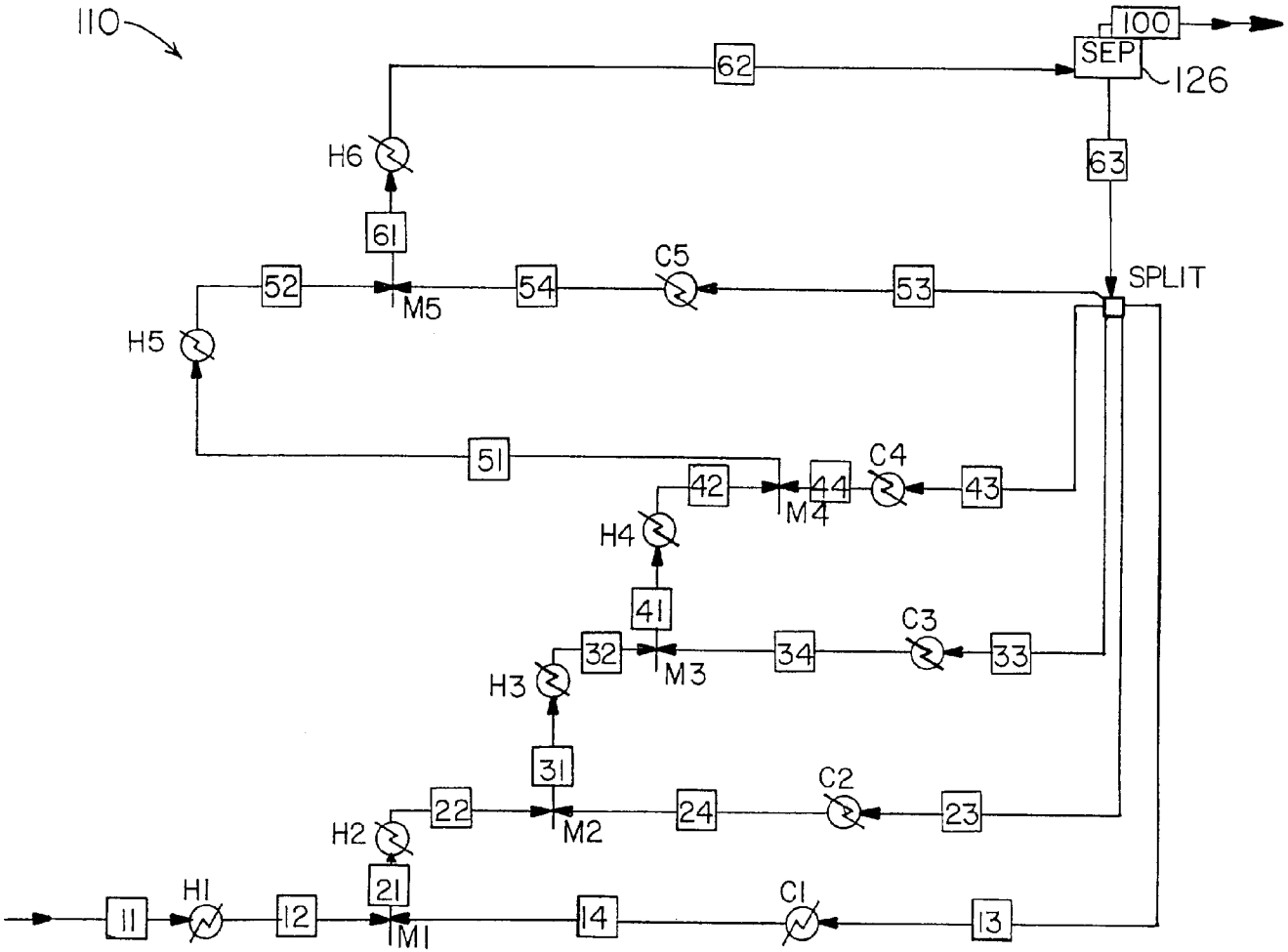
FIG. 2 is a flow schematic of the stratified vapor generator illustrated in FIG. 1.
Figure 3:
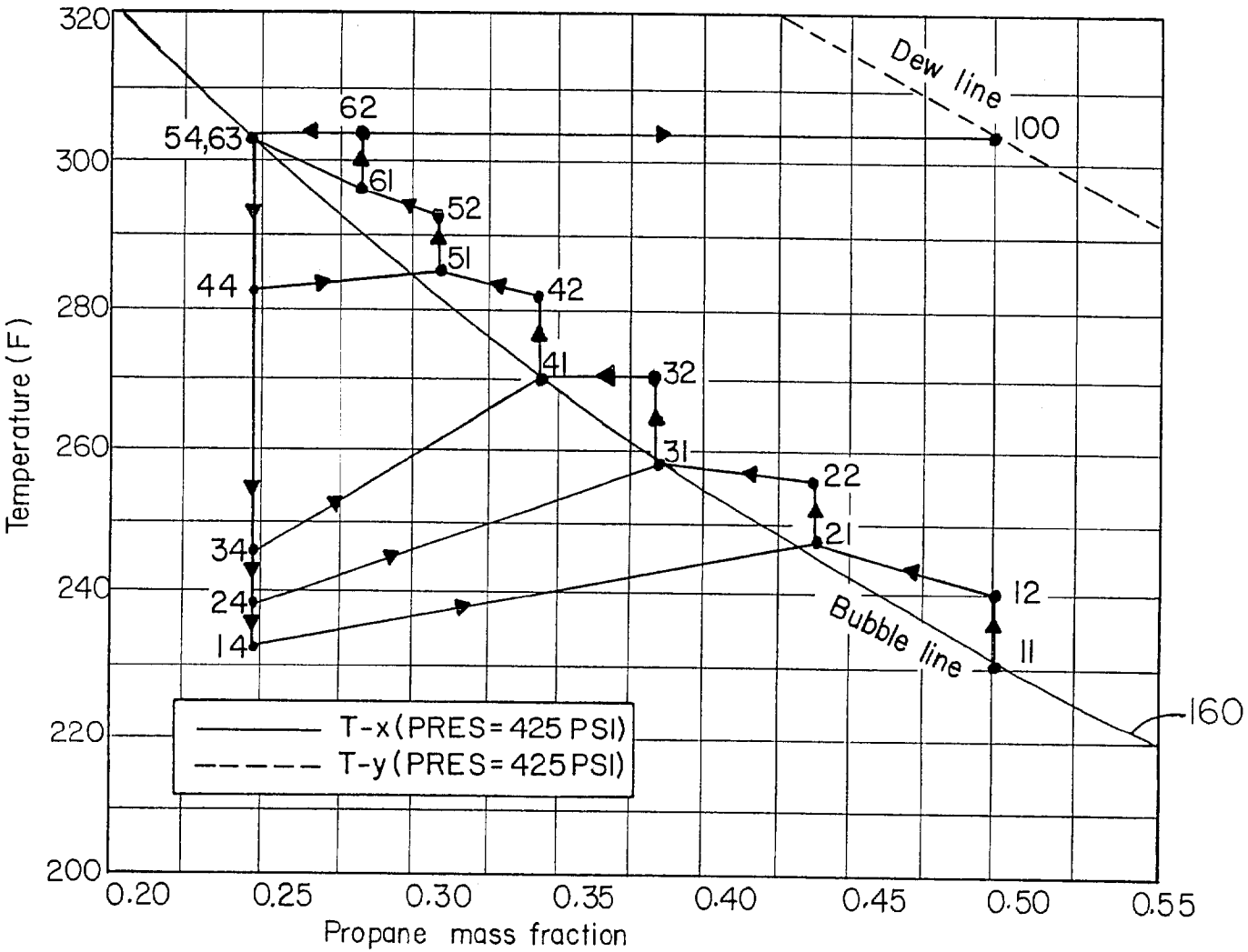
FIG. 3 is an equilibrium/phase diagram for the mixed working fluid that may be utilized in one embodiment of the stratified vapor generator.
Figure 4:
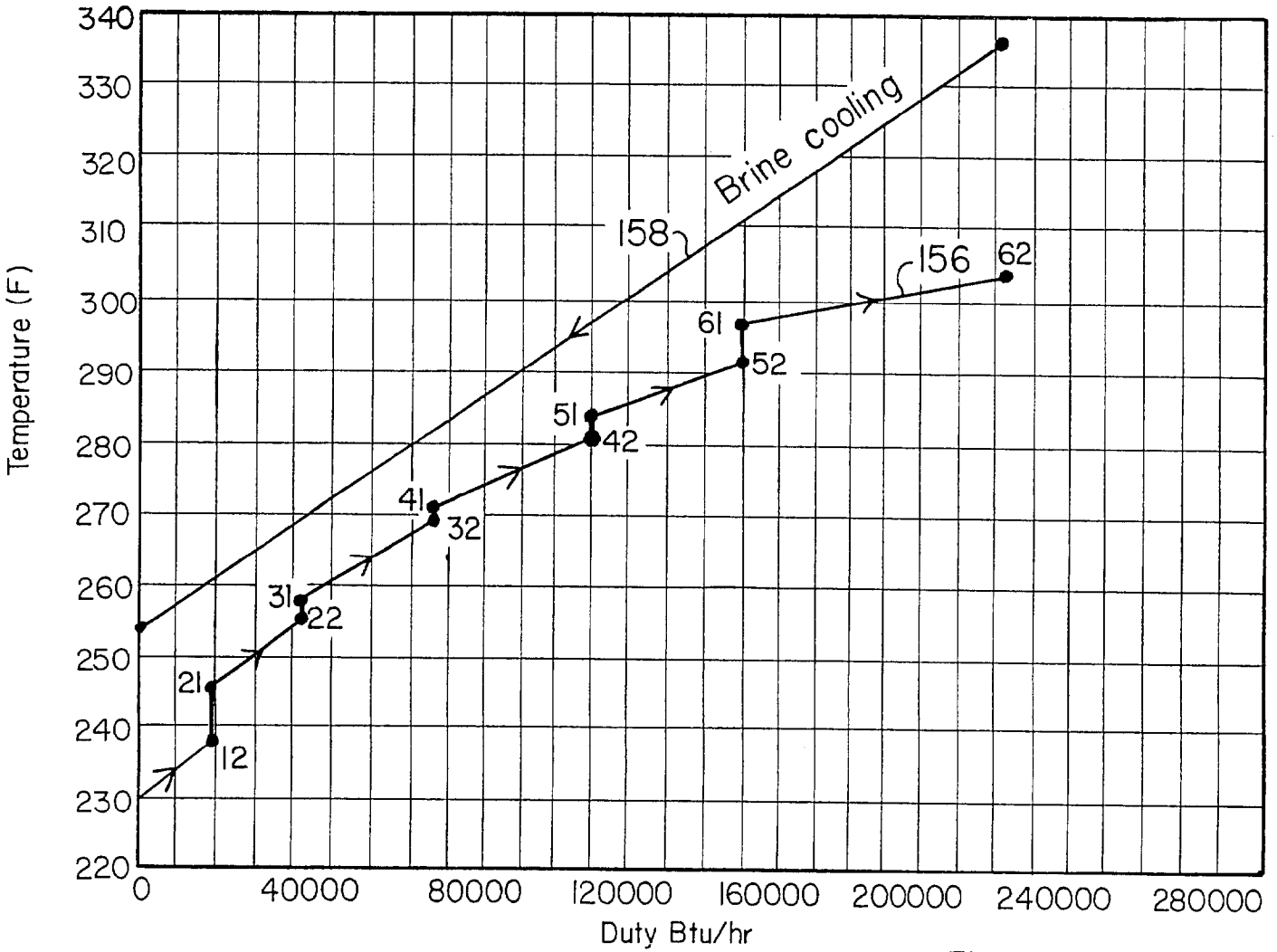
FIG. 4 is a graphical representation of the heating and cooling functions of the mixed working fluid and the heating fluid in the stratified vapor generator.

Referring now to FIGS. 1-3 simultaneously, the mixed working fluid feed stream 142 enters the first heating section $H_1$ at about the bubble point of the mixed working fluid. This corresponds to station 11 illustrated in FIG. 2 and to point 11 in FIG. 3. As an aside, it should be noted that most of the stations, e.g., 11, 12, 13, 14, etc., illustrated in FIG. 2 are also illustrated in FIGS. 3 and 4 as corresponding points with identical numbers. For example, station 12 in FIG. 2 (i.e., the conditions of the working fluid stream exiting the first heating section $H_1$) is indicated in FIGS. 3 and 4 as corresponding points 12. It should also be noted that, due to the natures of the curves illustrated in FIGS. 3 and 4, not every station illustrated in FIG. 2 is illustrated as a corresponding point in FIGS. 3 and 4.

Continuing now with the description, the mixed working fluid is heated at constant pressure in the first heating section $H_1$ to some temperature that is above the bubble temperature of the mixed working fluid. This corresponds to station 12 illustrated in FIG. 2 and to point 12 illustrated in FIG. 3. After exiting the first heating section $H_1$, the heated mixed working fluid is combined at mixing section $M_1$ with a cooled liquid component stream 146 exiting the first cooling section $C_1$. As will be described in greater detail below, the temperature of the cooled liquid component stream 146 (i.e., station 14 in FIG. 2 and point 14 in FIG. 3) is selected so that the working fluid enters the next available heating section in the liquid state (i.e., at about 0% quality). A second consideration is that the amount of heat added to the mixed working fluid by the next available heating section be such that the vapor volume fraction of the heated mixed working fluid exiting the next available heating section (i.e., heating section $H_1$, station 22) is substantially constant and equal to the vapor volume fractions of the mixed working fluid as it exits the other heating sections. That is, each of the points 12, 22, 32, 42, 52, and 62 shown in FIG. 3 (which represent the exit stations of the respective heating sections $H_1$-$H_6$) are all equally displaced from the bubble line 160. Stated another way, the points 12, 22, 32, 42, 52, and 62 represent a substantially constant vapor volume fraction of the heated mixture exiting each corresponding heating section $H_{1-6}$. As used herein, the term "vapor volume fraction" refers to the ratio of the volume of the vapor component to the total volume (i.e., the volumes of the vapor and liquid components) of the mixed working fluid. The ratio is then multiplied by 100 to allow the vapor volume fraction to be expressed as a percentage. In the present invention, it is generally preferred that the substantially constant vapor volume fraction be in the range of about 10% to about 30%.

The mixed working fluid continues to be heated in the subsequent heating sections $H_3$, $H_4$, $H_5$, and $H_6$, being mixed at respective mixing points $M_2$, $M_3$, $M_4$, and $M_5$ with corresponding cooled liquid streams 148, 150, 152, and 154 from respective cooling sections $C_2$, $C_3$, $C_4$, and $C_5$ in the manner best seen in FIG. 1. As described above, the temperature of each respective cooled liquid stream 148, 150, 152, and 154 is selected so that the mixed working fluid enters the next available heating section in liquid form. The heating provided by the next available heating section is such that the vapor volume fraction of the heated mixed working fluid exiting the next available heating section remains substantially constant, e.g., in the range of about 10% to about 30%. The heated mixed working fluid stream 132 exiting the last heating section $H_6$ corresponds to station 62 in FIG. 2 and to point 62 in FIG. 3.

The heated mixed working fluid stream 132 is directed to the separator system 126 which separates the liquid component 128 and the vapor component 130 from the mixed working fluid stream 132. The liquid component 128 exits the liquid outlet 144 of separator system 126, whereupon it is directed through the cooling sections $C_{1-5}$. As is best seen in FIG. 3, each cooling section $C_1$-$C_5$ cools the liquid component 128 to the various temperatures indicated by points 14, 24, 34, 44, and 54. The vapor component 130 exiting the separator system 126 is at a quality of about 100%. That is, the vapor component 130 is at the dew point. See station 100 in FIG. 2 and point 100 in FIG. 3. Thereafter, the vapor stream 130 may be super-heated (i.e., heated beyond the dew point), if desired, and directed to suitable energy conversion apparatus (e.g., turbine 134) in the manner already described.

A significant advantage of the stratified vapor generator 110 according to the present invention is that it results in closely matched heating and cooling curves for the working and heating fluids, respectively. For example, with reference to FIG. 4 the heating curve or function 156 of the mixed working fluid closely follows the cooling curve or function 158 of the heating fluid (e.g., brine 114). The closely matched heating and cooling functions 156, 158, respectively, improves thermodynamic efficiency by reducing the irreversibilities occurring in the heat exchanger. The closely matched heating and cooling functions also allow the brine 114 to be cooled to a lower temperature, closer to the bubble point of the working fluid, than is possible with prior systems. Consequently, the stratified vapor generator substantially reduces the heating fluid (e.g., brine 114) flow rate required for a given amount of useful work. Accordingly, the stratified vapor generator can be used with considerable advantage in geothermal power generation systems wherein it is desired to minimize the brine flow rate per kilowatt of electricity produced.

Having briefly described one embodiment of the stratified vapor generator 110, as well as some of its more significant features and advantages, the various embodiments of the stratified vapor generator according to the present invention will now be described in detail. However, before proceeding with the description, it should be noted that while the stratified vapor generator system is shown and described herein as it could be used in a geothermal electrical generating system utilizing hot brine 114 as the heating fluid, the stratified vapor generator system is not limited to use in geothermal electrical generating systems. In fact, the stratified vapor generator could be used with any of a wide variety of heating fluids and in any of a wide range of thermodynamic cycles that are now known in the art or that may be developed in the future, as would be obvious to persons having ordinary skill in the art after having become familiar with the teachings of the present invention. Consequently, the stratified vapor generator of the present invention should not be regarded as limited to the particular applications and/or heating and working fluids shown and described herein.

With the foregoing considerations in mind, one embodiment of a stratified vapor generator 110 according to the present invention is shown and described herein as it could be used in a geothermal power generation system 112 to generate electrical power from a flow of hot brine 114, which serves as the heating fluid. Alternatively, other types of heating fluids may also be used. The working fluid used in one embodiment of the power generation system 112 may comprise any of a wide range of mixed, non-azeotropic fluids now known in the art or that may be developed in the future suitable for use in the particular thermodynamic system in which is to be used the stratified vapor generator system according to the present invention. As used herein, the term "mixed fluid" refers to any fluid wherein the temperature of the vapor and liquid components increases with increasing quality. By way of example, in the embodiment shown and described herein, the mixed working fluid comprises a mixture of propane and iso-hexane.

With reference now primarily to FIG. 1, the stratified vapor generator 110 may comprise a heat exchanger 116 having a primary loop 118 and a plurality of heating sections (e.g., $H_1$, $H_2$, $H_3$, $H_4$, $H_5$, and $H_6$) which together comprise a secondary loop 162. Before proceeding with the description it should be noted that the heat exchanger 116 must be provided with at least two heating sections, although any number of heating sections greater than two may also be provided. The exact number of heating sections that may be provided will depend on the heating requirements of the particular application, as well as on the degree of performance and efficiency desired or required. Consequently, the present invention should not be regarded as limited to a heat exchanger 116 having any particular number of heating sections.

The heat exchanger 116 is constructed so that the various heating sections $H_1$-$H_6$ are in series with one another in the manner best seen in FIG. 1. The heating sections are also arranged in a counter-current manner, with the first heating section $H_1$ being thermally adjacent the heating fluid outlet 120 of the primary loop 118 and the last heating section $H_6$ being thermally adjacent the heating fluid inlet 122 of primary loop 118. The counter-current arrangement of the heat exchanger 116, as well as the various mixing loops provided in the stratified vapor generator system, aid in closely matching the heating and cooling functions 156 and 158 (FIG. 4) of the working and heating fluids, respectively.

The various heating sections $H_1$-$H_6$ comprising the secondary loop 162 of the heat exchanger 116 may comprise any of a wide range of configurations and structural arrangements. For example, in one embodiment, each heating section $H_1$-$H_6$ may comprise a separate portion of the heat exchanger 116, with separate inlet and outlet sections associated with each heating section. In another embodiment, the various heating sections comprising the secondary loop 162 of heat exchanger 116 may comprise areas or regions of a substantially continuous heat exchange portion of the secondary loop 162. That is, the various heating sections may have functional inlets and outlets, but no specifically identifiable structural inlets and outlets. In such a heat exchanger configuration, the divisions between the various heating sections may be defined primarily by the mixing stations (e.g., $M_1$-$M_5$). That is, the first mixing station $M_1$ will be arranged so that it is functionally located at about the outlet of the first heating section $H_1$ and the inlet of the second heating section $H_2$. Still other configurations are possible. For example, each heating section could comprise a separate heat exchanger. In view of the various configurations and structural configurations that are possible for the heat exchanger 116, the present invention should not be regarded as limited to use with a heat exchanger having a particular configuration.

Regardless of the exact number of heating sections provided in a given configuration, the outlet 124 of the last heating section (e.g., $H_6$) is operatively connected to a separator system 126. The separator system 126 separates a liquid component 128 and a vapor component 130 from the heated mixed working fluid stream 132 exiting the heat exchanger 116. The separator system 126 may comprise any of a wide range of systems and devices that are well-known in the art or that may be developed in the future for separating vapor and liquid components of an incoming stream. Consequently, the present invention should not be regarded as limited to any particular type of separator system 126.

The liquid component 128 is drawn-off from the separator system 126 via a liquid outlet 144. Thereafter, the liquid component 128 is re-circulated to the heat exchanger 116 via at least one, and preferably a plurality of re-circulation branches. Generally speaking, the number of re-circulating branches will be equal to one less than the number of heating sections, although this need not be the case. For example, in the embodiment shown and described herein having six heating sections $H_1$-$H_6$, the stratified vapor generator 110 is provided with five (5) re-circulation branches, as best seen in FIG. 1. While it may be possible to directly inject each of the liquid component streams (e.g., 146, 148, 150, 152, and 154) to the heat exchanger 116, in most cases it will be necessary to cool some or all of the streams before they are injected into the heat exchanger 116. In the embodiment shown and described herein, each of the re-circulation loops is provided with a cooling section, $C_1$, $C_2$, $C_3$, $C_4$, and $C_5$, which cools the liquid component 128 at substantially constant quality to form the cooled liquid component streams 146, 148, 150, 152, and 154. The cooled liquid component streams 146, 148, 150, 152, and 154 are injected into the heat exchanger 116 at respective mixing stations or points $M_1$, $M_2$, $M_3$, $M_4$, and $M_5$.

The various cooling sections $C_1$-$C_5$ may comprise any of a wide range of cooling type heat exchangers (e.g., radiators) that are well-known in the art or that may be developed in the future suitable for cooling the liquid component 128 in accordance with the teachings of the present invention. Consequently, the present invention should not be regarded as limited to any particular type of heat exchanger or radiator system. Moreover, one or more of the cooling sections (e.g., $C_1$-$C_5$) may comprise heat exchangers provided in other parts of the overall thermodynamic system (e.g., the geothermal power generation system 112) wherein it may be necessary to heat other fluid streams. In this manner, the heat to be removed from the liquid component 128 in the various re-circulation branches may be beneficially utilized in other portions of the overall system. Whether such provisions would be required or desired in a particular system would be obvious to persons having ordinary skill in the art after having become familiar with the teachings of the present invention. Consequently, the ability to beneficially use the heat rejected from the various cooling sections in other parts of the system, and how such uses could be implemented, will not be discussed in further detail herein.

The various cooling sections $C_1$-$C_5$ may comprise individual sections of a single heat exchanger 166 in the manner illustrated in FIG. 1. Alternatively, the various cooling sections $C_1$-$C_5$ may comprise separate heat exchangers, as illustrated in FIG. 2. The cooling fluid (not shown) used to cool the mixed working fluid may comprise any of a wide range of fluids (e.g., water or air) suitable for cooling the mixed working fluid to the appropriate temperature. Consequently, the present invention should not be regarded as limited to the particular embodiments for the cooling sections that are shown and described herein.

The vapor component 130 from separator system 126 maybe drawn-off via a suitable vapor component outlet 164 provided therein. As mentioned above, the vapor component 130 may be used in any of a wide range of thermodynamic cycles and systems now known in the art or that may be developed in the future that would be suitable for converting into useful work the heat energy contained in the vapor component 130. Consequently, the present invention should not be regarded as limited to any particular type of thermodynamic cycle or any particular type of energy conversion device. However, by way of example, in one preferred embodiment, the vapor component 130 exiting the separator system 126 is directed to a turbine assembly 134. The turbine assembly 134 is in turn connected to an electrical generator 136. As is well-known, the vapor component 130 from the separator system 126 is expanded in the turbine 134 which drives the generator 136 to generate electrical energy. Thereafter, the exhaust stream 138 from the turbine 134 may be condensed in a condenser 140 before being returned to the heat exchanger 116 as feed stream 142.

It should be noted that the foregoing description of the energy conversion system for extracting heat energy from the vapor component 130 and converting it into useful work is presented in order to provide a better understanding of one system in which may be used the stratified vapor generator according to the present invention. No attempt is made to show or describe other systems, components, or devices which may be required or desired in any particular system or application. However, since the details of such systems are not required to understand or practice the present invention, the particular energy conversion system that is utilized in one preferred embodiment of the present invention will not be described in further detail herein.

The stratified vapor generator 110 according to the present invention may be operated as follows to vaporize a mixed working fluid comprising a feed stream 142. As was described above, the heating fluid may comprise geothermal brine 114 extracted from the earth. The geothermal brine 114 may enter the heating fluid inlet 122 of the heat exchanger 116 at a temperature of about 335° F., although other temperatures are possible. The mixed working fluid may comprise a mixture of propane and iso-hexane and is maintained at a pressure of about 425 pounds per square inch absolute (psia). Alternatively, other mixed fluids may be used at other pressures. The mixed working fluid vaporizes progressively over an increasing temperature range. That is, the temperature of the vapor and liquid comprising the heated mixed working fluid increases with increasing quality.

With reference now to FIGS. 1-3, the mixed working fluid feed stream 142 enters the first heating section $H_1$. It is generally preferred, but not required, that the fluid feed stream 142 enters the first heating section $H_1$ at about the bubble point of the mixed working fluid. This corresponds to station 11 illustrated in FIG. 2 and to point 11 in FIG. 3. The mixed working fluid is heated at constant pressure in the first heating section $H_1$ to some temperature that is above the bubble temperature of the mixed working fluid. This corresponds to station 12 illustrated in FIG. 2 and to point 12 illustrated in FIG. 3. After exiting the first heating section $H_1$, the heated mixed working fluid is combined at mixing section $M_1$ with the cooled liquid component stream 146 exiting the first cooling section $C_1$. As described above, the temperature of the cooled liquid component stream 146 (i.e., station 14 in FIG. 2 and point 14 in FIG. 3) is selected so that the mixed working fluid enters the next available heating section (e.g., $H_2$) substantially as a liquid (e.g., at about the bubble point for the mixture). Also, the amount of heat added by the next available heating section (e.g., $H_2$) is such that the vapor volume fraction of the heated mixed working fluid exiting the next available heating section (i.e., heating section $H_2$, station 22) is substantially constant and equal to the vapor volume fractions of the mixed working fluid as it exits the other heating sections. That is, each of the points 12, 22, 32, 42, 52, and 62 shown in FIG. 3 (which represent the exit stations of the respective heating sections $H_1$-$H_6$) are all equally displaced from the bubble line 160. Stated another way, the points 12, 22, 32, 42, 52, and 62 represent a substantially constant vapor volume fraction of the heated mixture exiting each corresponding heating section $H_{1-6}$. Generally speaking, higher pressures will allow higher vapor volume fractions without significantly adversely affecting efficiency. By way of example, in one preferred embodiment of the present invention, it is generally preferred that the substantially constant vapor volume fraction be in the range of about 10% to about 30%.

The mixed working fluid continues to be heated in the subsequent heating sections $H_3$, $H_4$, $H_5$, and $H_6$, being mixed at respective mixing points $M_2$, $M_3$, $M_4$, and $M_5$ with corresponding cooled liquid streams 148, 150, 152, and 154 from respective cooling sections $C_2$, $C_3$, $C_4$, and $C_5$ in the manner best seen in FIG. 1. Here again, the temperature of each respective cooled liquid stream 148, 150, 152, and 154 is selected so that the working fluid stream enters the next available heating section substantially as a liquid (e.g., at about the bubble point of the mixture). The amount of heat added to the mixed working fluid by the next available heating section is selected so that the vapor volume fraction of the heated mixed working fluid exiting the next available heating section remains substantially constant, e.g., in the range of about 10% to about 30%. The heated mixed working fluid stream 132 exiting the last heating section $H_6$ corresponds to station 62 in FIG. 2 and point 62 in FIG. 3.

The heated mixed working fluid stream 132 is directed to the separator system 126 which separates the liquid component 128 and the vapor component 130 from the mixed working fluid stream 132. The liquid component 128 exits the liquid outlet 144 of separator system 126, whereupon it is directed through the cooling sections $C_{1-5}$. As is best seen in FIG. 3, each cooling section $C_1$-$C_5$ cools the liquid component 128 to the various temperatures indicated by points 14, 24, 34, 44, and 54. The vapor component 130 exiting the separator system 126 is at a quality of about 100%. That is, the vapor component 130 is at the dew point. See station 100 in FIG. 2 and point 100 in FIG. 3. Thereafter, the vapor stream 130 may be super-heated (i.e., heated beyond the dew point), if desired, and directed to suitable energy conversion apparatus (e.g., turbine 134) in the manner already described.

With reference now to FIG. 4, the stratified vapor generator 110 according to the present invention closely matches the heating curve 156 of the mixed working fluid with the cooling curve 158 of the heating fluid (e.g., brine 114). The more closely matched heating and cooling functions or curves 156 and 158 reduces thermodynamic irreversibilities that occur during heating, thereby increasing efficiency. Perhaps more significantly, the stratified vapor generator 110 of the present invention significantly reduces the brine flow required per kilowatt of generated electricity. Consequently, the stratified vapor generator of the present invention represents a significant advantage in geothermal electrical generating systems.

It is contemplated that the inventive concepts herein described may be variously otherwise embodied and it is intended that the appended claims be construed to include alternative embodiments of the invention except insofar as limited by the prior art.

The invention claimed is:

1. A stratified vapor generator, comprising:

at least first and second continuous heating sections;

the first heating section having an inlet and an outlet;

the second heating section having an inlet and an outlet; the inlet of said second heating section being operatively associated with the outlet of said first heating section, the at least first and second heating sections progressively evaporating a mixed working fluid having at least two components that evaporate at different temperatures, the progressive evaporation maintaining a substantially constant vapor volume fraction through the at least first and second continuous heating sections without dividing the mixed working fluid;

a separator operatively associated with the outlet of said second heating section, said separator having a vapor outlet and a liquid outlet; and a cooling section having an inlet and an outlet, the inlet of said cooling section being operatively associated with the liquid outlet of said separator, the outlet of said cooling section being operatively associated with the inlet of said second heating section.

2. The stratified vapor generator of claim 1, wherein said first and second heating sections comprise portions of a heat exchanger.

3. The stratified vapor generator of claim 2, wherein said heat exchanger includes a heating fluid inlet and a heating fluid outlet.

4. The stratified vapor generator of claim 3, wherein said heat exchanger comprises a tube and shell heat exchanger.

5. The stratified vapor generator of claim 1, wherein said first and second heating sections comprise adjacent portions of a countercurrent heat exchanger so as to define a mixing region there between, the outlet of said cooling section being operatively associated with the mixing region.

6. The stratified vapor generator of claim 5, wherein said countercurrent heat exchanger includes a heating fluid inlet and a heating fluid outlet, the heating fluid inlet of said countercurrent heat exchanger being thermally adjacent to the outlet of said second heating section, the heating fluid outlet of said countercurrent heat exchanger being thermally adjacent the inlet end of said first heating section.

7. The stratified vapor generator of claim 6, wherein said countercurrent heat exchanger comprises a tube and shell heat exchanger.

8. A stratified vapor generator, comprising:

first heating means for heating a mixed fluid having at least two components that evaporate at different temperatures;

second heating means operatively associated with said first heating means for receiving all of the heated mixed fluid from said first heating means and additionally heating the heated mixed fluid to progressively evaporate the at least two components of the mixed fluid;

separating means operatively associated with said second heating means for separating a liquid component from additionally heated mixed fluid from said second heating means; and cooling means operatively associated with said separating means and said second heating means for cooling the liquid component from said separating means and for directing a cooled liquid component into said second heating means, wherein the cooled liquid component mixes with a portion of the mixed fluid to be heated in said second heating means.

9. A method for vaporizing a mixed fluid stream, comprising:

continuously heating the mixed fluid stream to progressively produce a heated mixture having a vapor component and a liquid component so that substantially all of a more volatile portion of the liquid component evaporates from the liquid component before a less volatile portion of the liquid component begins evaporating from the liquid component;

separating the liquid component from the vapor component;

cooling the liquid component to produce a cooled liquid component; and mixing the cooled liquid component with a portion of the mixed fluid stream being heated.

10. The method of claim 9, wherein the mixed fluid stream comprises a bubble point and wherein the step of mixing the cooled liquid component with a portion of the mixed fluid stream is done so that a resulting mixture is at about the bubble point of the mixed fluid stream.

11. The method of claim 9, wherein the step of heating the mixed fluid stream is terminated when a vapor volume fraction of the heated mixture is within a predetermined range of vapor volume fractions.

12. The method of claim 11, wherein the predetermined range of vapor volume fractions is in the range of about 10% to about 30%.

13. The method of claim 9, further comprising additionally heating a resulting mixture of the cooled liquid component and the portion of the mixed fluid stream being heated.

14. The method of claim 13, wherein the step of additionally heating is conducted so that a vapor volume fraction of the resulting mixture is maintained within a predetermined range of vapor volume fractions.

15. The method of claim 14, wherein the predetermined range of vapor volume fractions is in the range of about 10% to about 30%.

16. A method for vaporizing a mixed fluid stream, comprising:

progressively heating a mixed fluid stream having at least two components that evaporate at different temperatures in a heat exchanger to gradually produce a vapor component and a liquid component in the same mixed fluid stream and thereby maintain flow conditions through the heat exchanger;

separating the liquid component from the vapor component;

cooling the liquid component to produce a cooled liquid component; and mixing, in an intermediate section of the heat exchanger, the cooled liquid component with a portion of the mixed fluid stream being heated in the heat exchanger.

17. The method of claim 16, wherein the step of heating the mixed fluid stream is terminated when a vapor volume fraction of the heated mixture is within a predetermined range of vapor volume fractions.

18. The method of claim 17, wherein the predetermined range of vapor volume fractions is in the range of about 10% to about 30%.

19. The method of claim 16, wherein the mixed fluid stream comprises a bubble point and wherein the step of mixing the cooled liquid component with a portion of the mixed fluid stream is done so that a resulting mixture is at about the bubble point of the mixed working fluid.

20. The method of claim 19, further comprising the step of additionally heating the resulting mixture, said step of additionally heating being terminated when a vapor volume fraction of the resulting mixture is within a predetermined range of vapor volume fractions.

* * * * *